United States Patent [19]

Kurland

[11] Patent Number: 5,066,017

[45] Date of Patent: Nov. 19, 1991

[54] SUCTION CUP PROJECTILE FOR USE IN PADDLE GAME

[76] Inventor: Jeffrey Kurland, Topsail, #1, Marina del Rey, Calif. 90291

[21] Appl. No.: 614,840

[22] Filed: Nov. 14, 1990

Related U.S. Application Data

[63] Continuation-in-part of Ser. No. 483,863, Feb. 23, 1990, abandoned, Continuation-in-part of Ser. No. 370,446, Jun. 23, 1989, abandoned.

[51] Int. Cl.[5] ..... A63B 65/02

[52] U.S. Cl. ..... 273/344; 273/423

[58] Field of Search ..... 273/344, 416, 419, 420, 273/423

[56] References Cited

U.S. PATENT DOCUMENTS

| | | | |
|---|---|---|---|
| 1,601,885 | 10/1926 | Samsel | 273/344 |
| 2,499,029 | 2/1950 | McElroy | 273/420 |
| 2,745,666 | 5/1956 | Swartz | 273/412 X |
| 3,378,260 | 4/1968 | Hartel | 273/344 |
| 3,388,696 | 6/1968 | Hoverath et al. | 273/344 |
| 4,017,076 | 4/1977 | Bai | 273/412 X |
| 4,832,348 | 5/1989 | Exel | 273/412 X |

FOREIGN PATENT DOCUMENTS

| | | | |
|---|---|---|---|
| 2617168 | 11/1977 | Fed. Rep. of Germany | 273/344 |
| 407353 | 3/1934 | United Kingdom | 273/344 |

*Primary Examiner*—William H. Grieb

*Attorney, Agent, or Firm*—Poms, Smith, Lande & Rose

[57] ABSTRACT

A recreational game for two or more participants is disclosed which employs an aerodynamically designed, multiwinged airfoil projectile, together with at least one hand-held shield. The shield has a front face with a generally flat projectile receiving surface, a rear generally convex face generally configured to be supported by the natural form of a user's generally relaxed hand, and shock-absorbing chamber-defining means between the two faces to effectively cushion the user's hand against impact of the projectile. The shield includes a strap spaced from the back face by a hand-accommodating distance whereby a participant's hand is removably retained in the space by the pressure exerted against the hand by the disk and strap.

The projectile is thrown by one participant, and captured on the shield by a second participant via a suction device on the projectile.

14 Claims, 4 Drawing Sheets

Fig. 5.
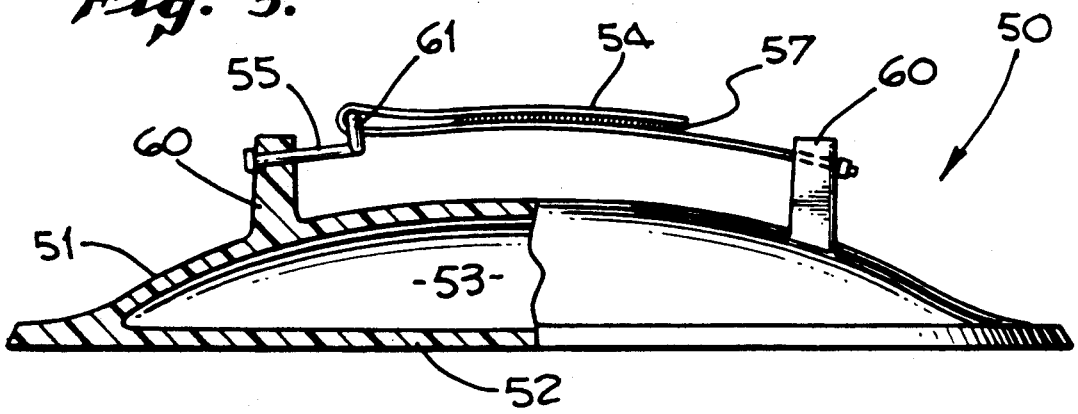
Fig. 6.
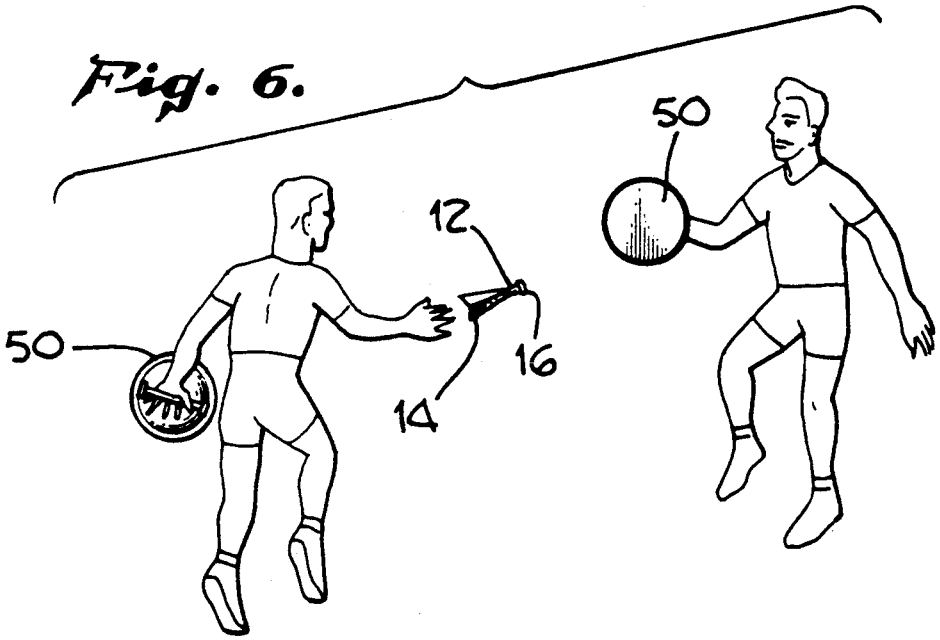
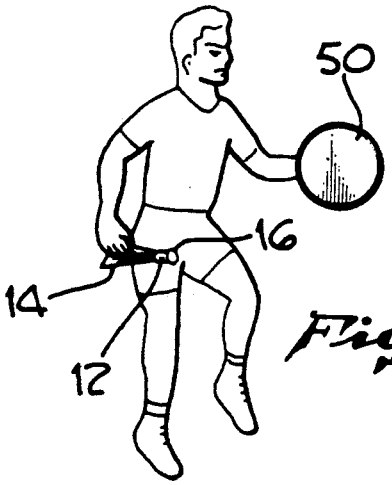
Fig. 7.
Fig. 8.
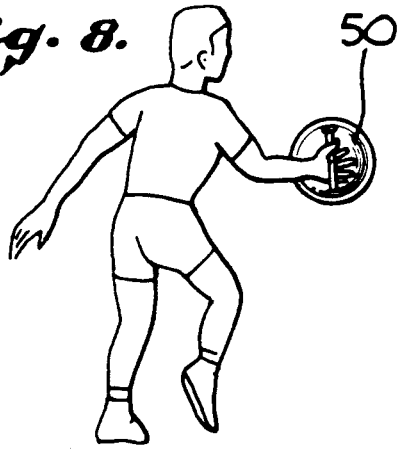

134
135
136
137
138
139
140
141
142
143
144
145
146
147
148
149
150
151
152
15
15

SUCTION CUP PROJECTILE FOR USE IN PADDLE GAME

RELATIONSHIP TO OTHER APPLICATIONS

This application is a continuation-in-part of application Ser. No. 07/483,863, filed Feb. 23, 1990 now abandoned. Application Ser. No. 07/483,863 was a continuation-in-part of application Ser. No. 07/370,446, filed June 23, 1989, now abandoned.

BACKGROUND OF THE INVENTION

1. Field of the Invention

This invention relates to games of the type having an aerial projectile and user-manipulated means for catching the projectile, and more specifically to games wherein the projectile has a suction cup and improved shields and projectiles for the same.

2. Description of the Prior Art

Conventional outdoor recreational games employ either a ball which is thrown, tossed or kicked between participants, or hit between participants through the use of a webbed or wooden paddle or racquet. Variations of games employing paddles or racquets include tennis, paddleball, racquetball, and smashball, and may rely on a netted court or walls. With the exception of smashball, the other games are limited to playing courts with nets or one or more walls. All of the foregoing outdoor recreational games which utilize paddles or racquets require considerably greater skill than those games in which a ball is thrown between participants. Where the participants' hands are used to catch a device, however, injury can occur to the palmar surface of the hand and fingers.

The game recited herein overcomes the aforementioned disadvantages by providing a highly interesting game that requires less skill than those utilizing paddles and racquets, but which protects the hands from injury. Because the game is not restricted to a particular playing field or court, and does not rely on nets or walls, the game can be played at the beach, park, backyard, or any other outdoor or indoor area which provides sufficient distance between participants.

SUMMARY OF THE INVENTION

It is an object of this invention to provide a game having an aerodynamic, multiple-winged airfoil projectile adapted to be caught on a shield or target, the projectile having a generally cylindrical body disposed about a longitudinally-extending axis, and a suction cup extending generally longitudinally from one end of the body.

It is a further object of this invention to provide an improved projectile for such a game.

It is still another object of this invention to provide improved shields or targets for use in such game.

These and other objects are preferably accomplished by providing at least one hand-held shield, the shield having a front face with a generally flat projectile receiving surface, a rear generally convex face generally configured to be supported by the natural form of a user's generally relaxed hand, and shock-absorbing chamber-defining means between the two faces to effectively cushion the user's hand against impact of the projectile. The projectile is adapted to be thrown by hand by one participant and to glide towards a second participant for suctioned capture on the receiving surface of the second participant's shield.

DESCRIPTION OF THE DRAWING

FIG. 5 is a side elevation view in section of a shield constructed in accordance with the invention;

FIG. 6 is an illustration of two participants engaged in the game described herein, with the illustrated distance between them greatly reduced;

FIG. 7 is an illustration of a participant gripping the projectile in one preferred manner;

FIG. 8 is an illustration of a participant holding the shield of FIG. 5 in one preferred manner;

DESCRIPTION OF THE PREFERRED EMBODIMENT

A recreational game is disclosed herein for two or more participants, and which can be enjoyed by those participants with little or no previous experience or training. The game employs a plastic hand-held shield for at least one participant, and an aerodynamically designed, multiple-winged, hand-throwable plastic airfoil projectile having a suction device at its leading end which removably adheres to the receiving surface of the plastic shield upon impinging contact therewith. The projectile and shield are used in the manner of throwing and fielding a ball, as illustrated in FIG. 6.

Figure 1:
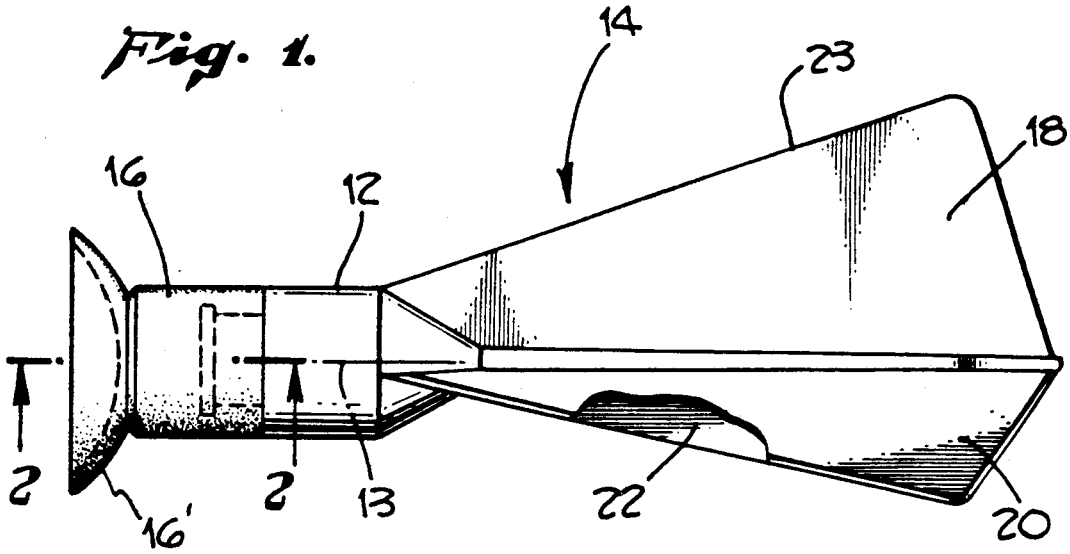
FIG. 1 is a side view of a preferred aerodynamic multiple-winged airfoil projectile constructed in accordance with the invention.

FIG. 1 is a side view of a multiple-winged projectile constructed in accordance with the invention. The projectile is formed by an aerodynamically designed, lightweight, plastic airfoil which can be thrown for a substantial distance through the air with little effort. The airfoil consists of a neck portion 12, a wing portion 14, and a leading suction portion 16.

FIG. 1 is a side view of a projectile constructed in accordance with the invention from a lightweight, impact resistant material such as a plastic or other polymer. The projectile comprises a generally cylindrical neck portion 12 formed about an axis 13 and of approximately 1 inch in diameter. A removably secured suction cup section 16 extends longitudinally from one end of the neck portion, and three wings 18, 20, 22 extend generally longitudinally from the other end of the neck portion 12.

Figure 2:
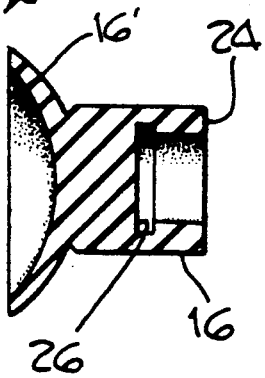
FIG. 2 is a longitudinal section of the suction cup device positioned at the end of the projectile in FIG. 1, and taken along line 2—2 therein.
Figure 3:
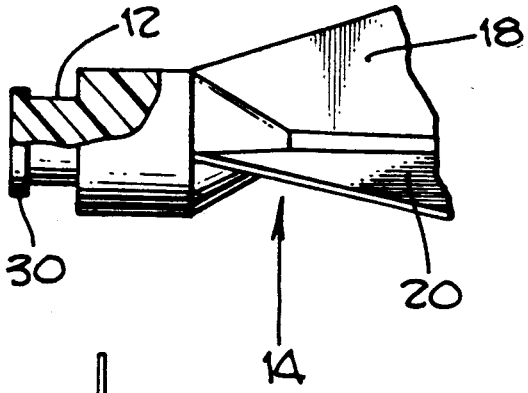
FIG. 3 is a side view of the projectile of FIG. 1, with the suction cup portion removed.
Figure 4:
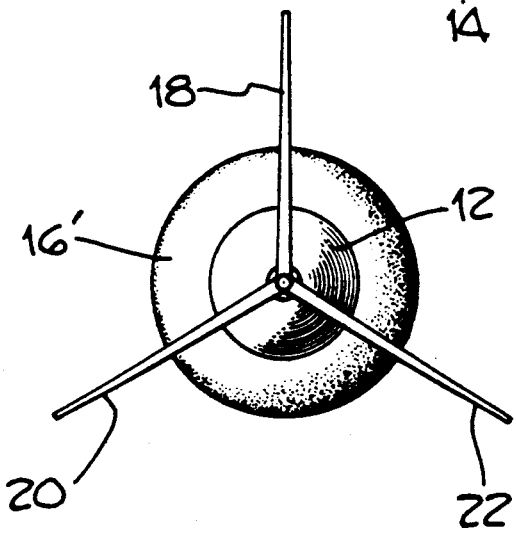
FIG. 4 is a rear view of the projectile.

The suction cup 16 is shown in section in FIG. 2 as having a generally tubular neck portion 24 which fits about the neck 12 of the projectile. The tubular neck 24 is formed from a resiliently stretchable material, such as rubber or another elastomer, and its opening is sized to firmly grasp the exterior of the projectile's neck 12 when placed thereon. To prevent the suction cup 16 from easily slipping off the projectile, while permitting the suction cup to be removed upon demand, the inner end of the opening is radially enlarged, as at 26, to snugly accommodate a radially enlarged lip 30 (FIG. 3) at the leading end of the projectile's neck 12. Consequently, the suction cup can be replaced when necessary, or can be used in combination with a set of projectiles having different trajectory characteristics.

The illustrated projectile is designed to fly in a substantially straight and accurate line between the throwing and receiving participants. The projectile accordingly has three substantially identical integrally formed, longitudinally-extending, blade-like, back-sloped wings 18, 20, 22 arranged equidistantly around the body of the projectile. The outer edges 23 of the wings flare radially outward as they extend back longitudinally, to provide an aerodynamic lift to the projectile that substantially counteracts the force of gravity as the projectile is propelled. As best shown in FIG. 1, the faces of each wing are solid for maximum effect lift. The suction cup 16 is sufficiently heavy to provide a counterweight to the wings which results in a lengthy and stable flight for the projectile. As shown in FIG. 1, the counterweight of the suction cup 16 is such that the projectile's center of gravity is at approximately the midpoint of the neck 12.

In stable flight, one wing points vertically upward to act as a stabilizing fin, and the other two wings point downward at an angle of approximately $\pm 120°$ from other wings respectively. The wing structure is sufficiently flexible to bend slightly with changes in air currents and turbulence, thereby maximizing the length and stability of its flight.

Owing to the winged structure of the projectile, and the counter weight of the suction cup device, the projectile may be gripped as illustrated in FIG. 7 by the wing which is to act as the fin, using the palmar surface of the thumb and other fingers, drawn back for an underhand throw with the wrist flexed back, and thrown underhand with a snap of the wrist just prior to release to achieve maximum distance with maximum accuracy. When thrown in this manner, the projectile is easily thrown a considerable distance with good degree of accuracy so that relatively unskilled participants can successfully engage in play. Unlike other projectile-type objects such as Frisbees and badminton shuttlecocks, the air foil projectile herein will fly substantially straight from one participant to the other regardless of whether it is thrown into the wind or against the wind.

The projectile is manually thrown by one participant to another participant, who captures the projectile by means of a shield, such as that illustrated in FIG. 5–8. The shield 50 preferably includes a front face 52 forming a generally flat projectile receiving surface, a rear generally convex face 51 configured to be supported by the natural form of a user's generally relaxed hand, and a shock-absorbing chamber 53 defined between the two faces to effectively cushion the user's hand against impact of the projectile. The chamber 53 is preferably filled with a gas, such as air. In practice, a suitable filled chamber has been found to essentially eliminate the sensation of impact by the projectile.

The shield 50 is constructed of a lightweight, impact resistant and moisture impervious molded plastic of a type that provides the flat-surfaced texture necessary to seal to the suction cup of the projectile as the projectile impacts against the shield's receiving face 52.

A strap 54 is provided on the back of the shield to secure the shield to the participant's non-throwing hand. The strap 54 is anchored to a one of a pair of diametrically opposite strap posts 60, and extends towards the other post where it passes through an eyelet loop 61 anchored to the second post 60 via a strap segment 55. The posts 60 are positioned to hold the strap along approximately the major diameter of the shield, with its ends generally equidistant from the closest edges of the shield.

The strap 54 has means such as complementary VELCRO surfaces 57 for proper and secure adjustment to comfortably slip around the volar aspect of the hand when the participant's palm is against the back face 51 of the shield. The participant can accordingly support the back surface of the shield with his/her fingers in their naturally relaxed position, while the strap evenly supports the shield on the hand's volar surface, as shown in FIG. 8. Consequently, the shield becomes a lightweight extension of the participants hand and arm which is easily and accurately moved about as the participant fields the projectile, without the fine motor coordination necessary in games requiring a glove or racket wherein the fingers must be flexed and/or extended in a particular matter, or the hand held in an unnatural position. If desired, the back face 51 can be provided with a textured surface for a more effective and pleasantly tactile grip.

The nature of the shield material, together with its ability to absorb the substantial amount of impact-generated force and to distribute the remaining force over the large surface area of the fingers and palm, effectively eliminates the participant's sensation of impact. At the same time, the ease of throwing and fielding the projectile assists in the development of motor skills of children and young adults by improving their large motor neuron hand-eye coordination, while substantially eliminating the typical discouragement which normally accompanies unsuccessful attempts to master the more intricate and subtle techniques of other games.

While numerous dimensions can be used, an overall projectile length of between 6 inches and one foot is preferred. Preferably, wings 18, 20, 22 may be 4.0 inches along side 23, 2.5 inches in width and about 4.5 inches along the centerlines thereof to neck 12. Neck 12 may be about 0.75 inches long and cup 16 about 1.25 inches long. Wings 18, 20, 22 may be about 60/1000 inches in thickness at the center tapering outwardly to a tip thickness of about 30/1000 inches. Cup 16 and neck portion 12 may be about 1 inch in diameter. The suction cup (FIG. 1) 16, may be about 1.75 inches in diameter. Shield 50 may be about 8.5 inches in diameter. Projectiles of those sizes are characterized by sufficiently stable flight over the relatively long distances that optimize enjoyment of the game, and possess sufficient inertia to both fly against the wind and effect a suitable degree of suction against the shield upon impact. Those skilled in the art will recognize that changes in projectile length may require suitable changes in other illustrated dimensions to achieve the results described herein, but that the changes are identifiable without undue experimentation.

Figure 9:
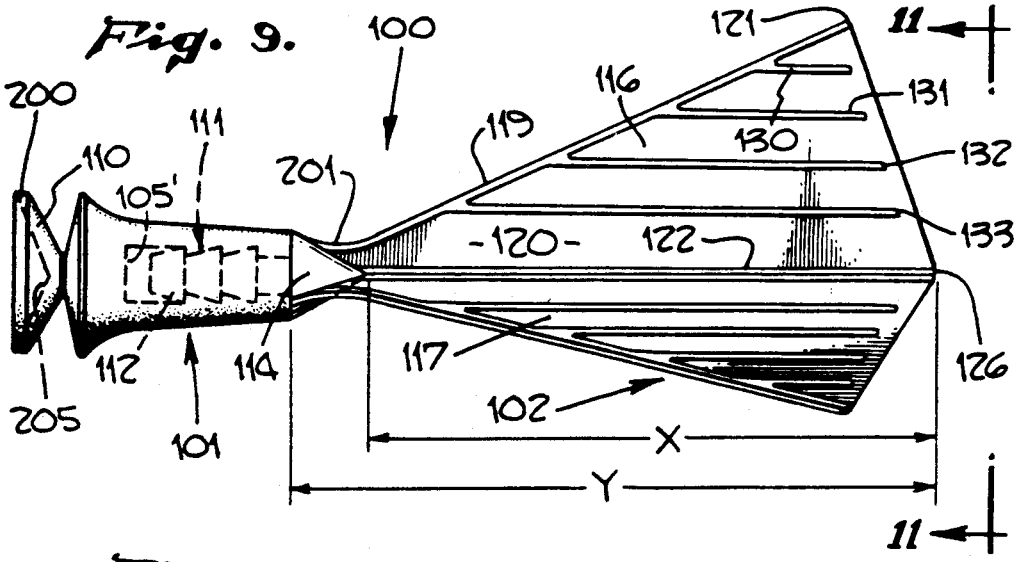
FIG. 9 is a side view of another embodiment of a projectile in accordance with the teachings of the invention.
Figure 10:
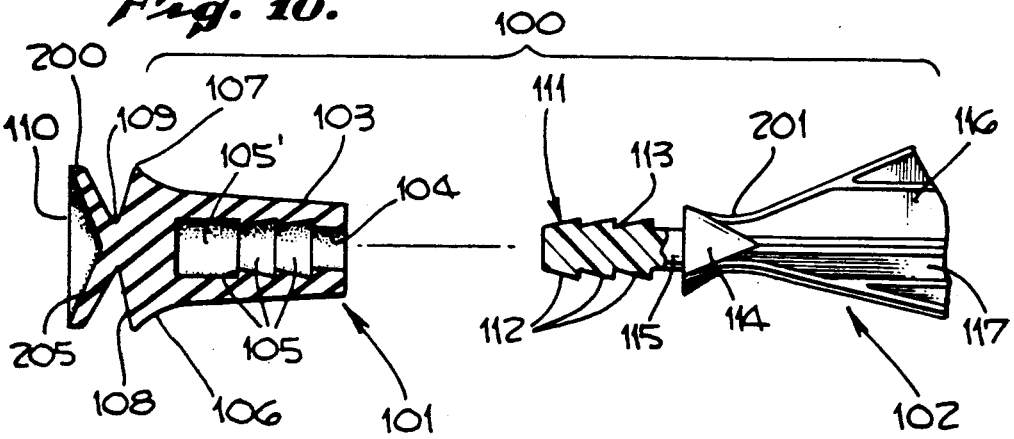
FIG. 10 is an exploded view, partly in section, of a portion of the projectile of FIG. 9.
Figure 11:
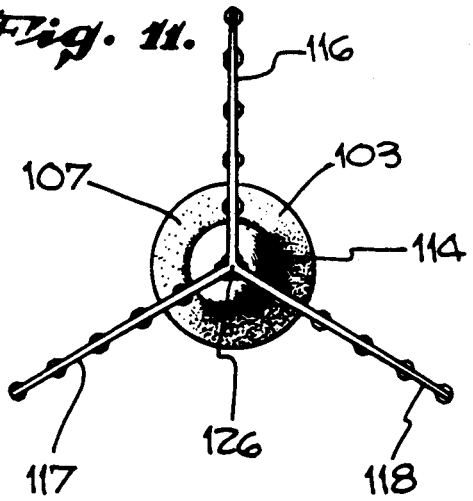
FIG. 11 is a view taken along lines 11—11 of FIG. 9.

Referring now to FIGS. 9-11, another variation of a projectile which is considerably more aerodynamically efficient than that shown in FIGS. 1-4, is shown. Projectile 100 is preferably of two pieces, a suction portion 101 (FIG. 10) and a wing portion An air space 105' is provided at the forward end of grooves 105 (FIG. 10) to provide a cushioning means upon impact. Suction portion 101 includes a generally cylindrical shaft portion 103 having a central bore 104 with a plurality of spaced grooves 105, which accommodates the nipple portion 111 of wing portion 102. Shaft portion 103 tapers outwardly at tapered portion 106 to apex 107 to create a ridge with a considerably larger diameter than that of the suction shaft portion 103, the shaft portion 103 gradually tapering from an approximate diameter of 1.0 inch at a point distal to the ridge to an approximate diameter of 875/1000 inches at the most distal end of the suction cup portion 101 where it meets wing head 114 of wing portion 102 when assembled. Apex 107 tapers inwardly at tapered portion 108 having a wall angle of about 75° to form a narrower diameter neck portion 109 integral with a suction cup 110.

The cup portion 110 of the suction portion 101 contains a thickened cylindrical lip 200 with a vertical dimension of approximately 156/1000 inches. The most anterior edge of lip 200 has a diameter generally equal to the diameter of apex 107, e.g., about 1.5 inches. The cup portion 110 contains a concavity which is generally pyramidally shaped having a wall angle of about 63° extending from the most anterior portion of lip 200 to the center point at the longitudinal axis of suction portion 101. The rear portion of cup 110 is generally pyramidally shaped having an outer wall angle of about 60° extending from the posterior aspect of lip portion 200 to join as an integral component of the generally narrower neck portion 109. There is a progressive increase in the wall thickness of cup 110 as it extends posteriorly from the lip 200 to neck portion 109, the wall thicknesses ranging from 156/1000 to 190/1000 inches.

Figures 13, 14, 15, 16:
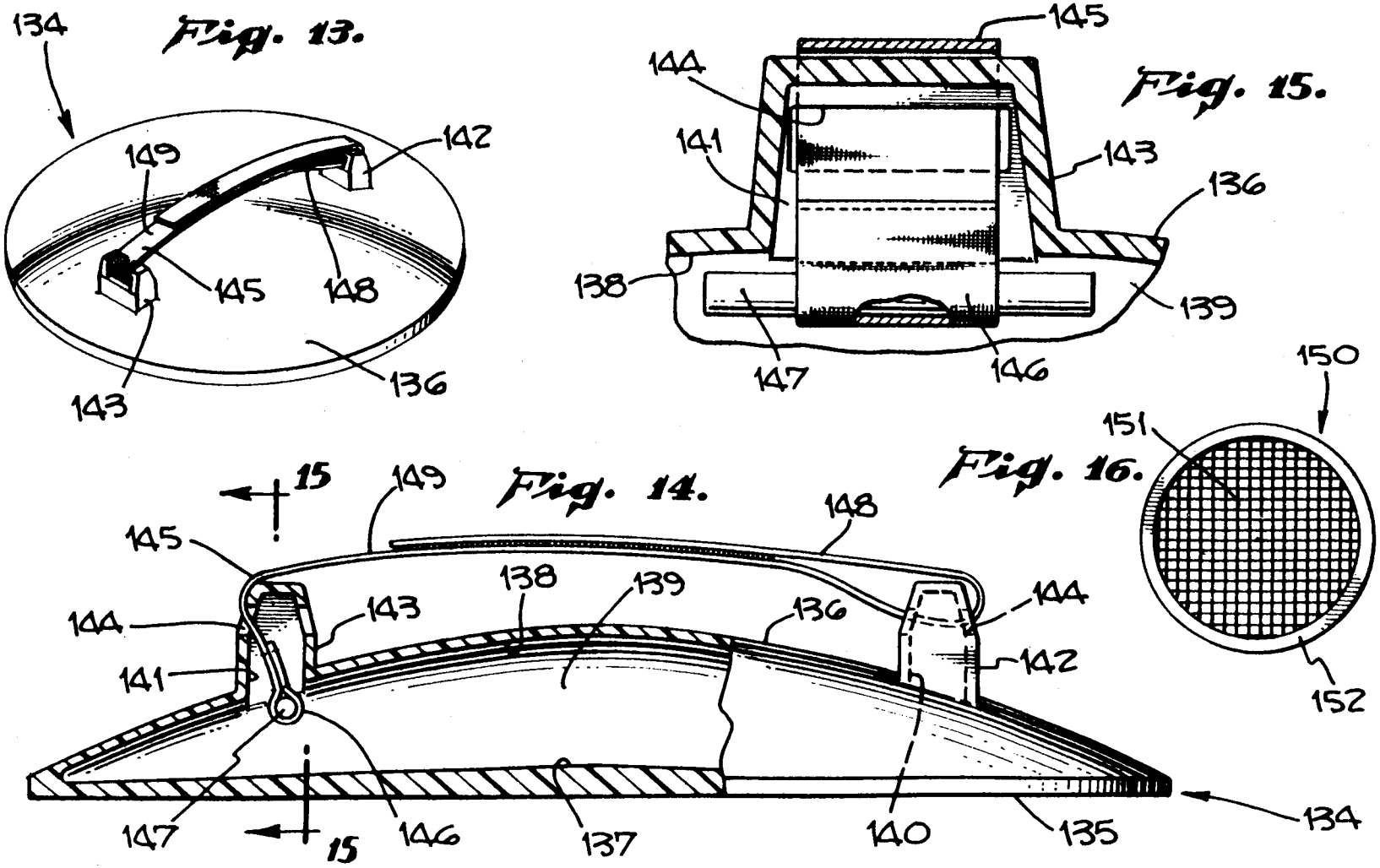
FIG. 13 is a perspective view of another embodiment of a shield in accordance with the teachings of the invention.
FIG. 14 is a side sectional view of the shield of FIG. 13.
FIG. 15 is a view taken along lines 15—15 of FIG. 14.
FIG. 16 is a vertical plan view of another shield in accordance with the invention.

The neck portion 109 of suction cup portion 101 creates a flexible pivot point for cup 110 allowing the cup 110 to achieve a seal and thereby readily adhere upon coming in contact at an acute angle with a flat surface, such as that of shield 134 as in FIG. 14. Suction cup 110 may be of a smaller or greater diameter than apex 107 and neck portion 109 and shaft portion 103 may be of one piece of a resilient material, such as plastic or rubber. Suction portion 101 may be of alcryn, santoprene or kraton plastics, or a similar elastomer, for example.

Suction portion 101 contains certain aerodynamic configurations which function in concert with wing portion 102, the configurations achieving aerodynamic lift of projectile 100. The thick circumferential lip 200 and progressively increasing wall thickness of cup portion 110 retards any tendency of the cup portion 110 to flex backwards thereby enabling substantially more air to flow closer toward apex 107 and shaft 103 than occurs with a thinner more flexible cup which flexes back deflecting air diagonally away from the apex 107 and shaft 103 of the suction portion 101, and away from the wing portion 102. The additional air available to apex 107 (a high pressure area) is pulled into a low pressure area created by the smaller diameter located distal to apex 107, the low pressure area causing a considerable increase in air velocity and aerodynamic lift due to the physical law of science referred to as the venturi effect. The gradual tapering diameter of shaft 103 of suction portion 101 creates an additional low pressure area causing an additional increase in air velocity and lift and causes the sheath of air to be held closer to shaft 103 to be directed toward the conical wing head 114 of wing portion 102.

Another advantage of the thick cylindrical lip 200 and the progressive increase in the wall thickness of cup 110 is that it causes the energy of impact to be diverted in a direction opposite to the expected force of impact thereby substantially reducing the forward moving energy contained within the forwardly propelled projectile 100 from being delivered onto, and imparted into, the receiving surface of shield 134. Upon impact, this forward moving energy is utilized to flex the thickened lip 200 and gradual tapered wall of cup 110 in a posterior direction, which substantially reduces the forward moving energy force and creates a highly efficient shock-absorbing mechanism which reverses the direction of the energy force in a posterior direction and imparting it through the longitudinal axis of the neck and shaft of the suction cup 110 and the longitudinal axis of the projectile 100.

The shock absorbing action of the assembly is an essential feature of projectile 100 because of the uniquely effective aerodynamic characteristics of projectile 100 (see also hereinbelow) which causes very efficient high speed linear flight creating a great degree of impact in a forward direction. The shock absorbing mechanism of projectile 100, in concert with the shock-absorbent gas-filled air chamber of shield 134 (see also hereinbelow), effectively and nearly completely eliminates any sensation of impact of the projectile 100 onto the receiving surface of the shield 134. In the event that the projectile 100 accidentally collides with any part of a player's body, the shock absorbing mechanism of the projectile 100 substantially reduces the extent of possible injury and is thereby an important safety feature of the device.

Another advantage of the thick cylindrical lip 200 of suction cup portion 101 is that it achieves a greater surface area of contact with a flat surface, such as that of the shield 134, the surface area increasing upon flattening of cup 110 upon contact.

Wing portion 102 has a leading nipple portion 111 with a plurality of spaced annular ridges 112 and annular valleys 113 adapted to be inserted into bore 104 and snap into grooves 105 with grooves 105 and the wall of bore 104 resiliently grasping nipple portion 111 to retain wing portion 102 to suction portion 101. The ridges 112 are coupled to a tapered wing head 114 by a cylindrical member 115. As seen in FIG. 9, a plurality, such as three, blade-like back sloping wings 116, 117 and 118 (see also FIG. 11) extend from wing head 114 arranged equidistantly around wing head 114.

Wings 116, 117 and 118, which are substantially identical and preferably integral with wing head 114 and nipple portion 111, come off the wing head by means of a fillet radius at area 201 (FIG. 9) of about 2.5 inches with the outer edge of each wing sloping back at an approximate 22.5 degree angle with respect to the center line of wing portion 102 located through the center point of the triangular component formed by the union of the three protrusions 123, 124 and 125 (FIG. 12) of the central rib 122. Along the center line of wing portion 102, the generally conical-shaped wing head 114 tapers from a diameter generally the same as the diameter of the distal aspect of the suction cup shaft 103 of approximately 875/1000 inches to a diameter of 380/1000 inches at a point where it becomes integral with the central rib 122. As shown particularly in FIG. 12, central rib 122 is generally Y-shaped having three main protrusions 123, 124 and 125 extending radially from a generally triangularly shaped midportion 126. Each protrusion has a generally square shaped main body portion 127 integral with midportion 126 which is in turn integral with a generally triangularly shaped portion 128, each wing 116, 117 and 118) being integral with each apex thereof (such as wing 117 being integral with apex 129 of portion 128 in FIG. 12). The distance from the center of portion 126 to each apex 129 is generally the same as the thickness of each main body 127 which tapers from approximately 180/1000 inches to 40/1000 inches at the most distal aspect of central rib 122.

The outer edges of each wing 116, 117 and 118 are each defined by a thickened rib 119 with a wall thickness of 190/1000 inches at the 2.5 inch fillet radius of area 201 coming off of the wing head 114 and tapering gradually to 54/1000 inches at the adjacent tip of the outer wing tip 121.

Figure 12:
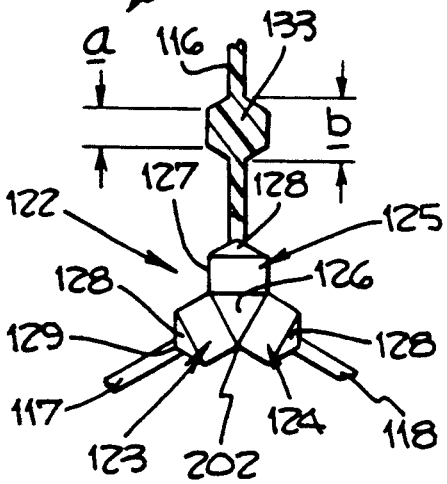
FIG. 12 is a detailed view of a portion of the view of FIG. 11.

Extending from the outer wing edge 119 is comprised the main body 120 of each wing 116 to 118 with a wall thickness gradually tapering posteriorly from 20/1000 to 10/1000 inches, within which are a plurality of spaced ribs extending from outer wing edge 119 and integral with the main body 120 of the wings 116 to 118 along a horizontal plane parallel to the center line of wing portion 102. As seen in FIG. 12, each rib 130 to 133, such as rib 133, is generally hexagonally-shaped in cross-section having a generally thicker cross-section in the dimension perpendicular to main wing body 120 and which at any given point along the center line of said cross-section is generally the same as the wall thickness of the outer wing edge ridge 119 located at the same point along the center line. This results in the projectile 100 favoring one direction of rotation when thrown and, obviously, the differing dimensions on each side of each rib 133 are uniform on all ribs 130–133 so that the heavier weight is on the same side of each wing 116–118.

Each wing 116 to 118 is about 5.8 inches in overall length (distance x in FIG. 9) along the outside wing edge 119 from the anteriormost point of wing head 114 to wing tip 121, and about 6.5 inches from the anteriormost point of wing head 114 to the rearmost end of the central rib 122. Tip 121 is disposed about 1.0 inch from the rearmost aspect of central rib 122 at the union 126 of the plurality of wings 116–118.

The spacing between longitudinal ribs 130–133 and the spacing between rib 130 and wing tip 121 and between rib 133 and central rib 122 is generally the same and approximately 0.5 inches. The outside wing rib 119 is at an angle of about 22.5 degrees with respect to central rib 122. Ribs 130 to 133 may taper gradually from the outside wing edge rib 119, the thickest portion being adjacent to outside wing edge rib 119 and generally similar in thickness to that of protrusion 125 in central rib 122 which may have a similar taper.

Wing portion 102 contains certain configurations causing unusual and highly efficient aerodynamic characteristics by incorporating a plurality of low pressure areas creating substantial lift, said low pressure areas which in concert with a plurality of spaced longitudinal ribs 130–133 and intervening channels in the main body 120 of wing portion 102 account for improved unidirectional flight.

Wing portion 102 receives air flow which has increased in velocity due to the low pressure areas located behind apex 107 and augmented by the gradual tapering diameter of shaft 103 of suction portion 101, the air flow entering another extreme low pressure area on wing portion 102 created by the acute taper in the diameter of the conically shaped wing head 114, the diameters decreasing from a proximal diameter of 875/1000 inches at the union of shaft 103 of suction portion 101 with wing head 114 to a diameter 380/1000 inches along the proximal aspect of the central rib 122 which comprises the Y-shaped configuration having three main protrusions from which are extended wings 116–118, the wings having a main body 120 with extremely thin wall thicknesses tapering from 20/1000 to 10/1000 inches. The decrease in wall thickness from 380/1000 to 20/1000 inches where wing head 114 extends into the main body of wings 116–118 adjacent to central rib 122 creates a low pressure area, the low pressure area augmented by the gradual tapering wall thickness of main body 120 from 20/1000 to 10/1000 inches at the distal end of wing portion 102. Within central rib 122, a low pressure area is created along the central axis of wing portion 102 due to the three main protrusions 123, 124 and 125 (see FIG. 12) between which is a generally triangulated groove, such as groove 202, which tapers in width and depth toward the distal end of wing portion 102. At each consecutive low pressure area air flow increases in velocity causing increased aerodynamic lift.

The thickened outside rib 119 of wings 116–118 also creates a plurality of low pressure areas within recessed spaces located distal to the thick outside wing edge rib 119 where the thick outside edge rib 119 extends into the considerably thinner main body 120 of wing portion 102. Progressively along outside wing edge rib 119 with wall thicknesses of 190/1000 to 54/1000 inches low pressure areas are created where the outside wing edge rib 119 extends into the main body 120 of wing portion 102 having a wall thickness of between 20/1000 and 10/1000 inches (FIG. 10).

A plurality of spaced longitudinal ribs 130–133 extending from the thick outside wing edge 119 at an angle of approximately 22.5 degrees from the back sloped outside wing edge 119 creates a plurality of low pressure channels between the plurality of ribs 130–133 on both surfaces of wings 116–118, the channels having a tapering depth of approximately 170/1000 to 45/1000 inches progressing distally along central rib 122 and along outside wing edge ridge 119 to wing tip 121. The approximately 22.5 degree back slopped angle of outside wing edge 119 angularly directs air flow into the channels within which said air flow is captured and increased in velocity as it travels distally within the thin walled low pressure channels creating aerodynamic lift. A polished smooth medial surface of the channels enhances high velocity unidirectional air flow within the channels. Roughened textured surfaces on the longitudinal ribs 130–133 causes air trapping within said ribs creating lift. The angular configuration of outside wing edge 119 causes air flow to be directed in a medial direction against the thin wall of main wing body 120 which comprises the medial wall of said channels and in an upward direction against the inferior surface of each of the plurality of longitudinal ribs 130–133 located on both sides of each wing 116–118, the combined effect of this medial and upward diversion of air flow being to cause the projectile 100 to be pushed in a forward and upward direction causing aerodynamic lift and improved unidirectionality over previous configurations to achieve highly accurate flight over a long distance.

The extreme thinness of the gradually tapered wall thickness of between 20/1000 and 10/1000 inches of the material comprising the main wing body 120 interdispersed between the considerably thicker longitudinal ribs 130–133 on wings 116–118 constitutes a very thin highly polished film or skin which achieves unusual flexibility and lightness of the wings 116–118. The flexibility of this film is counterbalanced by both the thick ridge on the outside wing edge 119 of each wing 116–118 and the plurality of spaced longitudinal ribs 130–133 on both surfaces of each wing 116–118, preventing collapse of the wings 116–118, while enabling each wing 116–118 to move independently around turbulent air forces, the wing movement minimizing irregular flight patterns which causes the projectile's flight characteristics to be extremely efficient under cross wind conditions. The airfoil has aerodynamic abilities, such as extreme unidirectionality, apart from the suction cup attached thereto. Regardless of how the airfoil is thrown, the unique wing configuration causes the airfoil to immediately turn its leading suction into the forward direction of flight and always right itself so one wing is perfectly vertically upright and the other wings are pointing diagonally downward at 120 degree angles.

FIGS. 13 and 14 show another variation of the shield of FIGS. 5 to 8, which offer significant advantages over that shown in FIGS. 5 to 8. Shield 134 includes a generally circular flat front 135 (FIG. 14) forming a flat projectile receiving surface and a rear generally convex wall 136, having a radius of curvature of preferably 15 inches, and configured to be supported by the natural anatomic position of a user's hand in its relaxed and most comfortable position. The 15 inch radius describing the degree of convexity, determined based upon anatomy and x-ray images of the human hand, has been found to be the same for both adults and children, which differ primarily in the longitudinal dimension of the palm and fingers. When used in conjunction with the adjustable Velcro strap (see below), the convex shape of the rear surface 136 of shield 134 provides a secure and comfortable fit accommodating the natural anatomic position of the hand in the relaxed position for users of nearly all ages.

The spacing between the inner wall 137 of face 135 and inner wall 138 of rear wall 136 forms a shock-absorbing chamber 139 to cushion the user's hand against impact of the projectile 100. This chamber 139 is preferably an air chamber and air outlets 140,141, outlet 140 being shown in dotted lines, are provided through wall 136 communicating the interior of chamber 139 with the exterior thereof. A pair of spaced posts 142, 143 are provided preferably integral with rear wall 136. Each post may be about 130/1000 inches in thickness at bottom tapering inwardly to a wall thickness of about 86/1000 inches. All of the parts of shield 134 heretofore mentioned may be of one integral piece of a suitable plastic material as is shield 50.

Each post 142, 143, such as post 142 in FIGS. 14 and 15, has a slot 144 therethrough. Outlet 141 communicates with the interior of post 143, which may be otherwise hollow, and outlet 140 communicates with the interior of post 142. A strap 145 of Velcro material has a looped end 146 disposed in chamber 139 with an elongated member 147 disposed in looped end 146 of a length greater than the overall length of outlet 141 (the width of strap 145 is generally related to the overall width of slot 144). The free end of strap 145 extends out of one side of slot 144 in post 143 and over to post 142, the length of strap 145 being such that one end, having VELCRO hook material 148 (for example), is looped through slot 144 in post 142 and extends out and overlaps a VELCRO loop portion 149 (for example) of strap 145. Thus, strap 145 is adjustable. The posts 142, 143 are positioned to hold strap 145 along approximately the major diameter of shield 134 with its ends generally equidistant from the closest edges of shield 134. The aforementioned comments regarding shield 50, where applicable, are also pertinent here. Of course, more than one set of posts interconnected by a strap may be used.

The front face 135 of shield 134 is preferably of a highly durable and flexible or resilient solid material which reversibly flexes backwards toward the inner wall 138 of the rear wall 136 upon impact by the projectile 100, causing the displacement of energy into the gas located within the air filled chamber 139. The air is effectively vented through air outlets 140,141 in the rear surface of the shield 134. The air outlets prevent the air located within air chamber 139 from being compressed by the backward flexing of the inner wall 137 of the front face 135, the flexing in a backward direction in the absence of said air outlets would otherwise displace the energy force against the inner wall 138 of rear wall 136 of shield 134 upon which the user's hand is in contact, providing a highly efficient shock-absorbing mechanism protecting the user's hand from any sensation of impact imparted by the contact of the projectile 100 with the front face 135 of handheld shield 134.

The thickness of wall 136 (between the inner and outer exterior thereof) is about 80/1000 inches. The thickness of face 135 (between the exterior and chamber 139) contains a circumferential gradual tapering which is 145/1000 inches at the centerpoint and 86/1000 inches at the peripheral rim, the circumferential tapering in the wall thickness of inner wall 137 of front face 135 causing a reduction in the energy of impact imparted by the projectile 100 onto the front face 135. The reduction occurs by the outward radial displacement of the energy of impact in a circular direction to the peripheral edge of inner wall 137 which contains a lip which extends posteriorly, the lip being at an approximate 90 degree angle with respect to front face 135, which further slows and disrupts and evenly distributes, and thereby minimizes, the energy force throughout the greater surface area of the convex rear face 136 upon which the user's hand is in contact.

The external wall of front face 135 of shield 134 is preferably highly polished to a very smooth surface to facilitate reversible adherence of the thick lip 200 of cup 110 of the suction portion 101 by eliminating any space for air leakage which would prevent a complete seal of cup 110. The thick lip 200 of the suction portion 101 as an integral part of the shock-absorbing mechanism described above is considerably less pliable than a cup with a thin lip, thereby requiring an extremely smooth surface to achieve an effective seal.

As seen in FIG. 16, another type of shield 150 may have, in place of a front solid face, such as face 135 of shield 134, a tennis racquet-like surface of strings 151 formed by cross strings of cat gut or synthetic material or the like as conventionally used in tennis racquets secured to rim 152. Thus, the rear wall of shield 150 (not shown) is otherwise identical to rear wall 136. A ball or the like can bounce off strings 151 similarly to a tennis ball bouncing off of a tennis racquet. Two or more players can thus play a game by batting a ball or the like back and forth.

It can be seen that there is disclosed projectiles and shields which can be used to play a variety of games. The configuration of the shield and projectile in FIGS. 3–14 contain unique features which represent improvements over existing art.

The shield has been specifically configured to withstand the extreme forces of impact generated by the unusually efficient projectile in order to provide maximum comfort and protection to the user. No other existing art allows this in the same way as does the shield described herein. The contoured rear surface of the shield conforms to the natural anatomy of the human hand in its relaxed and most comfortable position based upon a convex radius of the palmar surface of the hand which is the same for nearly all ages. The adjustable Velcro strap and rear surface texturing provides a secure and comfortable fit throughout hours of play.

The incorporation of a highly efficient air chamber completely eliminates any sensation of impact imparted by the projectile onto the front receiving surface of the shield which flexes backwards upon impact forcing air within the chamber to be vented through a plurality of air outlets on the shield's rear surface. Additionally, the circumferentially tapered inner wall of the receiving front surface of the shield causes the radial displacement of energy waves to the shield's peripheral edge were they are disrupted along the acute posterior angled lip and distributed onto the greater surface area of the shield's convex rear surface causing a significant reduction in impact energy conveyed to the user's hand.

The combination of the configurations of the devices produces a lively low frequency sound upon contact of the projectile with the shield which fascinates players.

The improved configuration of the shields herein can be used alone to bat a ball or the like back and forth between two or more players and provides for greater control and accuracy than is possible with conventional racquets which require the player to tightly grasp a handle.

The suction portion has been specifically configured to achieve intrinsic aerodynamic capabilities which augment the improved aerodynamic characteristics of the high performance wing configuration. Additionally, the suction portion contains unique shock-absorbing features which effectively displace and reduce the forward force of impact generated by the projectile at the moment of impact. This shock-absorbing feature is an important safety characteristic of the suction portion which protects users from possible injury and represents an improvement over existing art.

The wings of the projectile represent a new type of a high performance airfoil configuration with uniquely efficient aerodynamic capabilities apart from the suction cup, as for example, the extreme unidirectionality heretofore mentioned. The incorporation of a series of thick cross-sectional wing edges in relation to the extremely thin and tapered main wing body containing a plurality of spaced longitudinal thick cross-sectional ribs achieves a unique aerodynamic configuration which possesses improved lift, and unidirectionality and imperviousness to variable and turbulent wind conditions. In concert with the suction portion, the projectile creates a plurality of low pressure areas which pulls air flow into a plurality of high velocity thin walled channels which produces highly accurate and balanced linear flight over long distances with the expenditure of minimal thrust, such as that which is achieved with the flick of a human wrist. The airfoil configuration described herein is therefore an improved aerodynamic design which represents an improvement over existing art and has potential applications in areas other than the recreational games described herein.

While the foregoing description includes detail which will enable those skilled in the art to practice the invention, it should be recognized that the description is illustrative in nature and that many modifications and variations will be apparent to those skilled in the art having the benefit of these teachings. For example, other lightweight materials may be easily substituted for the plastic disclosed above. Fluorescent colors or impregnation may be used on the projectile and/or shields to enhance play under low-light conditions. In addition, the suction device may be a part of the shield, rather than a part of the projectile.

It is accordingly intended that the invention herein be defined solely by the claims appended hereto and that the claims be interpreted as broadly as permitted in light of the prior art.

I claim:

1. A projectile for use in a recreational game having a wing portion and a suction cup portion, said suction cup portion having a generally cylindrically main body portion with a suction cup at one end and said wing portion extending from the other end, said wing portion having a plurality of spaced wings providing airfoils, each of said wings radially extending from and integral with an elongated main rib portion coincident with the central axis of said cylindrical portion and extending therefrom, each of said wings having a generally flat planar body portion with an outer rib extending from said cylindrical portion to the terminal end of its respective wing and at an angle to said main rib portion, and a plurality of spaced ribs extending generally parallel to said main rib portion along each of said wings.

2. In the projectile of claim 1 wherein said suction cup portion includes said suction cup, a reduced neck portion integral with said suction cup, said neck portion integral with said main body portion, said wing portion having a wing head integral with said wings, said wing head having a nipple portion removably insertible in a hole in said main body portion.

3. In the projectile of claim 2 wherein said suction cup has a thick lip at the distal end thereof;

4. In the projectile of claim 2 wherein the interior of said suction cup is generally pyramidally-shaped.

5. In the projectile of claim 4 wherein the exterior of said suction cup is generally pyramidally-shaped.

6. In the projectile of claim 2 wherein said main body portion has a tapered portion extending from said reduced neck portion to an apex, said main body portion tapering from said apex to a generally cylindrical portion connected to said wing head, said cylindrical portion tapering from said main body portion tapering from said apex inwardly toward generally the central longitudinal axis of said cylindrical portion.

7. In the projectile of claim 6 wherein said suction cup has a thickened lip at the distal end thereof, the outer diameter of said lip being substantially the same as the outer diameter of said apex.

8. In the projectile of claim 2 including a plurality of spaced annular ridges on said nipple portion adapted to mate with a plurality of spaced annular grooves provided in the wall surrounding said hole with an air space.

9. In the projectile of claim 1 wherein three such wings are provided, each extending radially from said main rib portion and equally spaced thereabout.

10. In the projectile of claim 1 wherein each of said outer ribs tapers in thickness from said main body portion to the terminal end thereof, said thickest portion being disposed adjacent said main body portion.

11. In the projectile of claim 1 wherein each of said spaced ribs is generally hexagonally spaced in cross-section.

12. In the projectile of claim 11 wherein each hexagonally-shaped cross-section is longer on one side thereof than the other, each such longer side being on the same side of each of said wings.

13. In the projectile of claim 1 wherein three such wings are provided, said main rib portion being a generally Y-shaped member having a first generally triangular center portion, a generally square-shaped portion integral with each side of said triangular center portion, and a second generally triangular portion integral with the side of said square-shaped portion opposite the side thereof integral with said triangular center portion, the apex of each of said second triangular portions having each wing extending outwardly therefrom.

14. In the projectile of claim 1 wherein each of said spaced ribs tapers in thickness from said suction cup portion to the distal ends of said wings, the thickest portions thereof being adjacent said suction cup portion.

* * * * *